US005322254A

United States Patent [19]

Birkmeier

[11] Patent Number: 5,322,254

[45] Date of Patent: Jun. 21, 1994

[54] MOUNTING DEVICE

[75] Inventor: Stephen J. Birkmeier, Delphos, Ohio

[73] Assignee: U.S. Metalcraft, Delphos, Ohio

[21] Appl. No.: 58,264

[22] Filed: May 10, 1993

[51] Int. Cl.[5] ..... A47F 5/08

[52] U.S. Cl. ..... 248/231.9; 47/41.1; 248/27.1

[58] Field of Search ..... 248/231.9, 56, 346, 248/27.1, 27.8; 47/41.1, 41

[56] References Cited

U.S. PATENT DOCUMENTS

| | | | |
|---|---|---|---|
| 2,754,625 | 7/1956 | Rasmussen | 47/41.1 |
| 2,810,990 | 10/1957 | Wright | 47/41.1 |
| 2,898,705 | 8/1959 | Carlson | 47/41.1 |
| 3,044,214 | 7/1962 | Gill | 47/41.1 |
| 3,052,065 | 9/1962 | Rettman | 47/41.1 X |
| 3,229,948 | 1/1966 | King | 248/346 |
| 3,328,914 | 7/1967 | Newman | 47/41.1 |
| 3,377,043 | 4/1968 | King | 47/41.1 X |
| 3,434,235 | 3/1969 | Gordon | 248/346 X |
| 4,306,376 | 12/1981 | Strassacker | 248/346 |
| 5,213,290 | 5/1993 | Moretti | 248/56 |

FOREIGN PATENT DOCUMENTS

| | | | |
|---|---|---|---|
| 766855 | 9/1967 | Canada | 47/41.1 |

*Primary Examiner*—J. Franklin Foss

*Attorney, Agent, or Firm*—Emch, Schaffer, Schaub & Porcello Co.

[57] ABSTRACT

A mounting device for a rigid member such as a stone or concrete slab is disclosed. The slab has an opening which receives a sleeve. A continuous locking member has an inner surface complementary with the sleeve and an outer inclined surface adjacent the slab. A ring member has a flange mounted on the top of the slab and a hub connected to the sleeve. An object such as a cemetery vase is mounted in the ring member. A connector joins the vase to the ring member.

12 Claims, 1 Drawing Sheet

MOUNTING DEVICE

BACKGROUND OF THE INVENTION

The present invention relates to a mounting device for connection to a rigid member having an opening therethrough. Such mounting devices are utilized, for example, to mount a container or sleeve to a stone or concrete slab, which is positioned adjacent a grave in a cemetery. The container or sleeve includes an outer mounting ring which receives a base of a cemetery vase. Normally, a chain or other device is connected between the vase and the ring to protect against theft.

A prior art mounting device is shown in FIG. 1 of the drawings. A ring or flange member is mounted at the upper end of a sleeve and is positioned within an opening provided in a slab. A second ring member surrounds the sleeve at the bottom of the slab. A plurality of bolts extend between the upper flange member and the lower ring member securing the mounting device to the slab.

While the present invention is directed to a cemetery usage where the slab is, for example, a granite slab, the mounting device of the present invention is also suitable for other uses, such as attaching a metal pipe to a concrete slab.

The primary object of the present invention is to provide an improved mounting device for attaching a ring and connected sleeve to a slab.

SUMMARY OF THE INVENTION

The present invention is directed to a mounting device for a rigid member, such as a slab having an opening therethrough. A longitudinally extending sleeve is provided for positioning in the opening. The sleeve and slab define a space surrounding the sleeve. A continuous locking member has an inner surface complementary with the outer surface of the sleeve and an inclined outer surface. The locking member has a top and a bottom. The inclined outer surface extends outwardly from the top toward the bottom. The locking member is positioned within the space between the rigid member and the sleeve for locking the sleeve to the rigid member. Preferably, a ring member having a circular flange is positioned adjacent the rigid member and includes a hub extending downwardly into the sleeve.

DESCRIPTION OF THE PREFERRED EMBODIMENT

Figure 4:
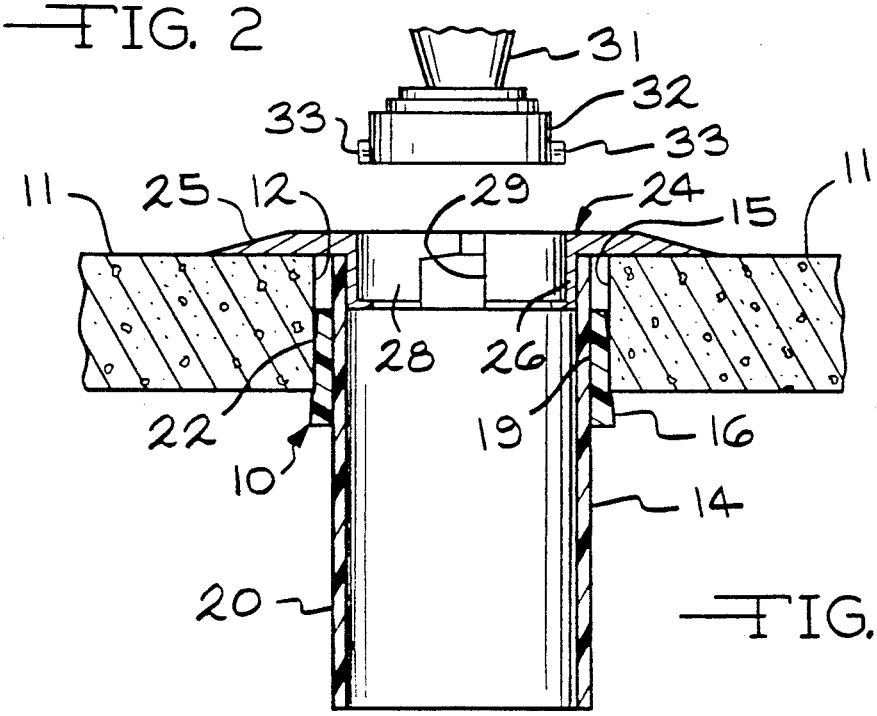
FIG. 4 is an exploded cross-sectional view of the mounting device, according to the present invention, and showing a portion of a cemetery vase.

Referring to FIG. 4, a mounting device, according to the present invention is generally indicated by the reference number 10. A granite cemetery slab 11 includes a circular opening 12. The mounting device 10 includes a longitudinally extending sleeve 14 for positioning within the circular opening 12. In the present embodiment, the sleeve 14 is cylindrical, however, it can have other configurations, such as a rectangular configuration. The present sleeve 14 is constructed of a plastic material, however, it also may be constructed of a metal. In the FIG. 4 embodiment, the sleeve 14 is constructed of an extruded PVC material.

Figure 2:
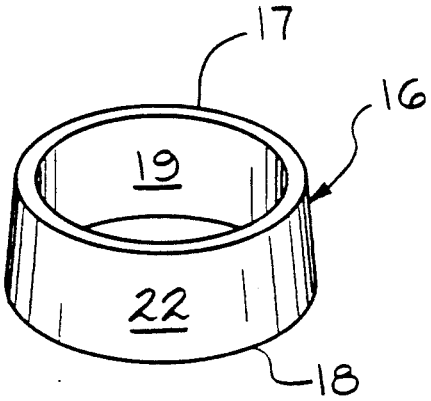
FIG. 2 is a perspective view of a mounting device, according to the present invention.
Figure 3:
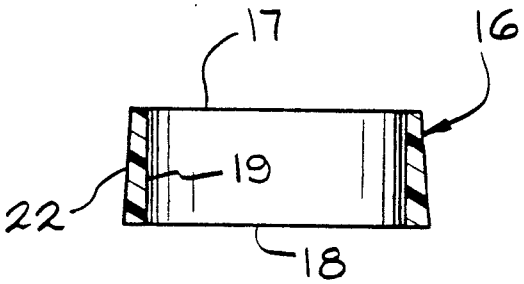
FIG. 3 is a cross-sectional view of the mounting device shown in FIG. 2.

The slab 11 and the sleeve 14 define a cylindrical space 15. A continuous locking member 16 is positioned within the cylindrical space 15 between the slab 11 and the sleeve 14. Referring to FIGS. 2 and 3, the locking member 16 has a top 17 and a bottom 18. The locking member 16 also has an inner surface 19 complementary with an outer surface 20 of the sleeve 14. The locking member 16 also has an inclined outer surface 22 extending outwardly from the top 17 toward the bottom 18. As shown in FIG. 4, the locking member 16 is positioned between the rigid member or slab 11 and the sleeve 14 for locking the sleeve 14 to the slab 11. The locking member 16 is preferably constructed of a resilient material, such as a plastic material. In the present embodiment the plastic material is a polyester material.

A metallic ring member 24 has a circular flange 25 mounted adjacent the upper surface of the slab 11. The ring member 24 includes an integral circular hub 26 which is connected to the sleeve 14 and extends downwardly into the interior of the sleeve 14. In the present embodiment the ring member 24 is constructed of a die cast aluminum. However, other metals or other materials can be used, such as a sand cast, bronze material.

The hub 26 includes an interior circular surface 28. In the present embodiment, the interior surface 28 defines opposed reversed "L" shaped paths or channels 29. The reversed "L" shaped paths or channels serve as a retaining means for locking an object to the mounting device 10. Referring to FIG. 4, a cemetery vase 31 includes a base 32 having mating members or detents 33 extending outwardly from the base. The detents 33 are received in the reversed L-shaped paths defined by the hub 26. Rotation of the detents 33 locks the vase 31 to the mounting device 10.

Figure 1:
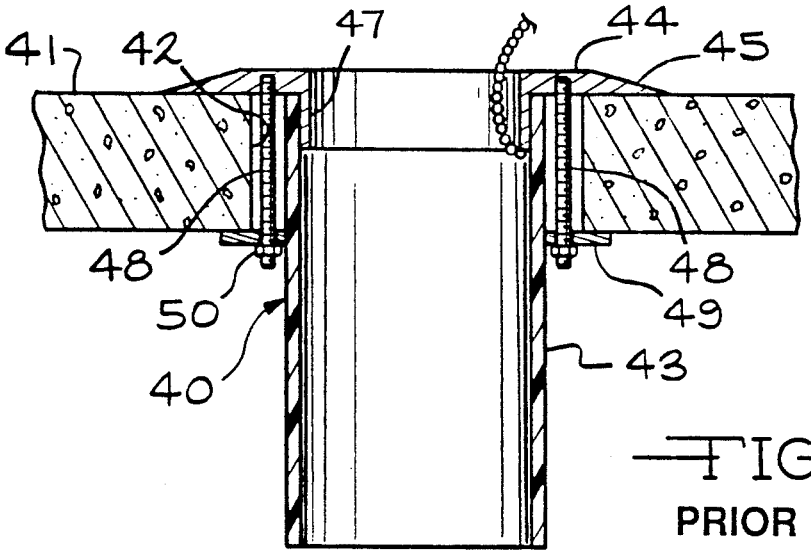
FIG. 1 PRIOR ART
FIG. 1 is a cross-sectional view of a prior art mounting device.

A prior art mounting device 40 is shown in FIG. 1. A slab 41 has an opening 42 which receives the mounting device 40. A sleeve 43 extends downwardly through the opening 42 and mounts a ring member 44 at its upper end. The ring member 44 includes a circular flange 45 adjacent the upper surface of the slab 41 and a hub 46 received in the sleeve 43.

In this prior art embodiment, the mounting device 40 is connected to the slab 41 by a plurality of bolts 48 which extend between a lower horizontal mounting ring 49 and the flange 45 of the ring member 44. The bolts 48 receive nuts 50 which are tightened to secure the components in place.

In the prior art embodiment, a retaining means is also provided on the hub 46. The retaining means comprises a chain 52 which is engaged with, for example, a cemetery vase (not shown). A similar retaining chain may be also used in the mounting device 10, according to the present invention, rather than the retaining means shown in FIG. 4.

Many revisions may be made to present invention without departing from the scope of the above described invention or from the following claims.

I claim:

1. A mounting device for a rigid member having an opening therethrough comprising, in combination, a longitudinally extending sleeve for positioning in such opening, said sleeve and said rigid member defining a space surrounding said sleeve, a continuous resilient locking member has an inner surface complementary with the outer surface of said sleeve and an inclined outer surface, said locking member having a top and a bottom, said inclined outer surface extending outwardly from said top toward said bottom, said locking member positioned between said rigid member and said sleeve for locking said sleeve to said rigid member.

2. A mounting device, according to claim 1, wherein such opening and said sleeve are circular.

3. A mounting device, according to claim 1, wherein said locking member is constructed of a resilient plastic.

4. A mounting device, according to claim 3, wherein such resilient plastic is a polyester material.

5. A mounting device, according to claim 2, including a ring member having a circular flange positioned adjacent said rigid member and a hub connected to and extending downwardly into said sleeve.

6. A mounting device, according to claim 5, wherein said ring member includes retaining means for connection to an object to be mounted in said ring member.

7. A mounting device, according to claim 6, wherein said retaining means comprises a chain connected to said ring member.

8. A mounting device, according to claim 6, wherein said hub includes an interior circular surface and wherein said retaining means comprises a shaped path in said interior circular surface of said hub for receiving a mating member on said object.

9. A mounting device for a slab having an opening therethrough, comprising, in combination, a longitudinally extending sleeve for positioning in such opening, said sleeve and said slab defining a space surrounding such sleeve, a ring member mounted on said sleeve, said ring member having a flange positioned adjacent said slab and an integral hub extending downwardly into said sleeve, and a continuous resilient locking member having a top and a bottom, said locking member having an inner surface complementary with the outer surface of said sleeve and an inclined outer surface, said inclined outer surface extending outwardly from said top toward said bottom, said locking member positioned between said slab and said sleeve for locking said sleeve to said slab.

10. A mounting device, according to claim 9, wherein such opening and said sleeve are circular.

11. A mounting device, according to claim 9, wherein said locking member is constructed of a plastic material.

12. A mounting device, according to claim 9, wherein said ring member includes retaining means for connection to a cemetery vase.

* * * * *